United States Patent [19]

Aldridge et al.

[11] 4,035,297

[45] July 12, 1977

[54] CLOSURE FOR ROOF DRAIN

[76] Inventors: Malcolm G. Aldridge, 836 Laurel Ave., Macon, Ga. 31201; William E. Aldridge, 1522 N. 59th St., Kansas City, Kans. 66102

[21] Appl. No.: 631,648

[22] Filed: Nov. 13, 1975

[51] Int. Cl.[2] ..... E03F 5/06

[52] U.S. Cl. ..... 210/163; 137/362; 251/339

[58] Field of Search ..... 210/163–166, 210/460, 462, 463; 137/362; 251/339

[56] References Cited

U.S. PATENT DOCUMENTS

| | | | |
|---|---|---|---|
| 965,999 | 8/1910 | Faget | 251/DIG. 1 |
| 1,487,161 | 3/1924 | Holt | 210/166 |
| 3,884,809 | 5/1975 | Logsdon | 210/163 |

FOREIGN PATENT DOCUMENTS

| | | | |
|---|---|---|---|
| 1,162,778 | 2/1964 | Germany | 210/164 |

*Primary Examiner*—Bernard Nozick

*Attorney, Agent, or Firm*—Diller, Brown, Ramik & Wight

[57] ABSTRACT

This disclosure relates to a closure device for a roof drain comprising a generally inverted cup-shaped cap having an apex portion and a peripheral skirt terminating in a peripheral edge carrying peripheral sealing means for engaging an area outboard of a roof drain, and a threaded rod passing through the apex portion for rotationally connecting the closure device to a roof drain closure whereby upon rotation of the threaded rod the peripheral sealing means will be brought into contact with a peripheral area outboard of a roof drain to form a seal for retaining a predetermined quantity of water upon a roof for fire prevention purposes.

3 Claims, 3 Drawing Figures

CLOSURE FOR ROOF DRAIN

Many buildings include flat or slightly inclined roofs which are provided with water drain pipes for the simple purpose of draining water from the roofs in a customary manner. Such drains obviously accomplish the intended purpose, but in the case of fire they are a detriment since any water applied to the roof by fire hoses or the like will simply run off and not protect the roof or the interior of the associated building from fire damage. Obviously if water is entrapped upon the roof, the latter will not be appreciably damaged because any breakthrough of the fire through the roof will be circumvented by the water reservoir thereupon.

It is known, for example, that commercial establishments maintain fork lifts upon roofs of buildings on a standby basis in order that the same may position sand bags atop roof drains so that water from fire hoses can submerge the roof in water in the event of a fire. Obviously the cost involved in such cases is quite prohibitive, and the purpose of the present disclosure is to eliminate such high costs in a rather simple yet efficient manner by a structure which assures the rapid closure of any roof drains and/or the maintenance of a predetermined water level upon any associated roof.

In keeping with the foregoing, a primary object of this invention is to provide a generally cup-shaped cap which is screw threaded to an apertured drain closure and includes upon a peripheral edge of a skirt thereof a gasket which will assure a peripheral seal between the cap and an associated roof such that water upon the roof, be it a natural accumulation or that deposited thereon during a fire, will be retained to preclude and/or reduce fire damage.

In further accordance with this invention, the cup-shaped cap is provided with aperture means in the peripheral skirt to maintain a desired level of water upon the roof when the cap is in its closed position with the peripheral sealing means engaged against the roof outboard of the drain closure.

Still another object of this invention is to provide a novel closure device of the type aforesaid wherein the cap can be rotated to a closed position simply by directing a stream of water against a handle in the form of a large wing-nut whereby the cap can be rapidly rotated to its closed position solely under the influence of water issuing from a fire hose during emergency fire conditions.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
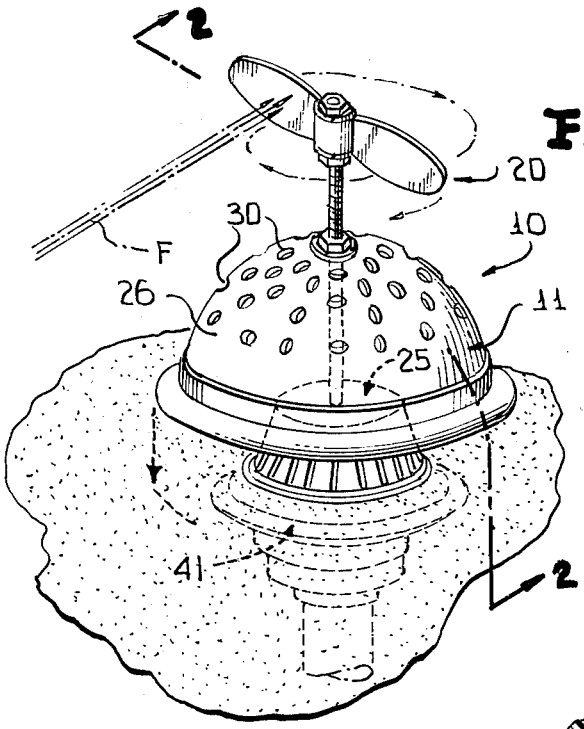
FIG. 1 is a perspective view of the novel closure device of this invention, and illustrates an inverted cupshaped apertured cap carried by a threaded stem which in turn has secured thereto a handle against which water can be directed for rotating the cap to bring a peripheral seal thereof into sealing engagement with a roof outboard of an associated drain closure.

A novel closure device for a roof drain constructed in accordance with this invention is generally designated by the reference numeral 10 and includes a generally inverted cup-shaped cap 11 of a semi-spherical configuration. The cap cap 11 includes an apex portion 12 (FIGS. 2 and 3) provided with a bore 13 through which passes rod means 14 in the form of a rod threaded generally its entire length including a lower end portion 15 and an upper end portion 16 thereof. The rod 14 passes through the aperture 13 and is adjustably fastened to the cap 11 by a pair of nuts 17, 18. The upper end portion of the rod 14 carries means generally disignated by the reference numeral 20 in the form of a handle or enlarged wing nut which is reactive to a force applied thereto for rotating the rod 14 and the cap 11 carried thereby. The wing nut 20 is secured to the upper threaded portion 16 of the rod 14 by suitable nuts 21, 22. Manual rotation of the wing nut 20 will obviously rotate the cap 11, but more importantly the purpose of the wing nut 20 is to permit water to be directed thereagainst from a fire hose in the manner indicated in FIG. 1 by the lines of force F. Thus, if it is desired to close a roof drain, generally designated by the reference numeral 25, all that need be done is to have the water from a fire hose directed against the wing nut 20 along the lines of force F to rotate the wing nut 20, the rod 14, and the cap 11 carried thereby.

Figure 3:
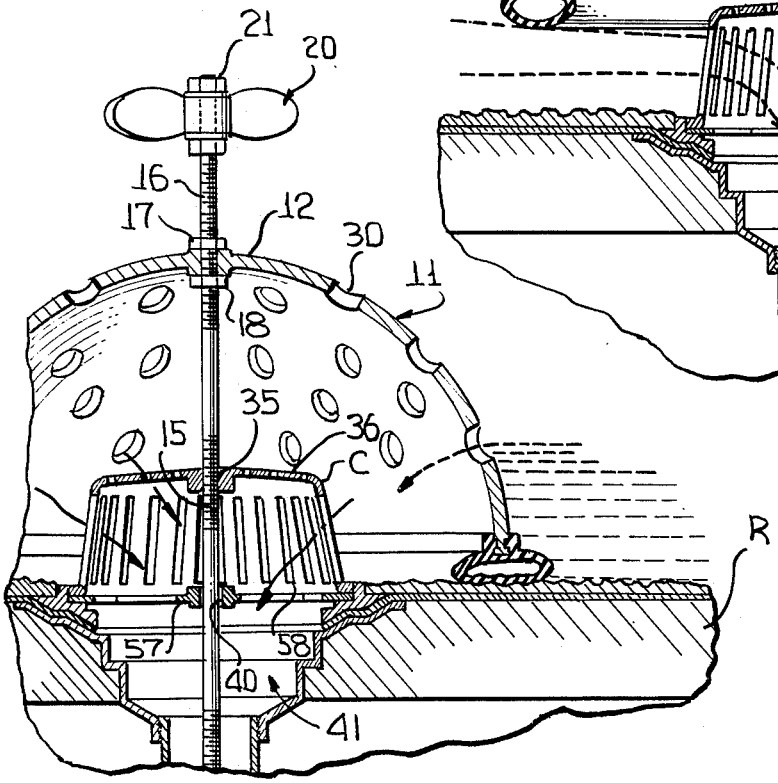
FIG. 3 is a fragmentary sectional view similar to FIG. 2, and illustrates the cap in its closed position.

The cap 11 in addition to including the apex portion 12 includes a peripheral skirt 26 having a terminal edge 27 carrying a peripheral seal 28. A plurality of apertures 30 are provided in the peripheral skirt 26 with the lowermost apertures being spaced a predetermined distance above the peripheral seal 28 to assure the maintenance of a predetermined level of water upon a roof R (FIG. 3) when the cap 11 is in its closed position (FIG. 3). In other words, with the cap 11 in its closed position, water will be maintained at a desired level upon the roof R as it determined by the spacing of the lowermost ones of the apertures 30 from the peripheral seal 28.

The closure device 10 is rotatably secured to a conventional apertured drain closure 25 (FIG. 3) by a threaded connection between the lower end portion 15 of the rod 14 and a threaded bore 35 formed in an upper wall 36 of the drain closure 25. Prefereably, the closure device 10 additionally includes a plate 37 having a plurality of apertures 38 for purposes of drainage and a central aperture 40 to axially guide the motion of the rod 14 in the manner readily apparent in FIGS. 2 and 3. The plate 37 is merely seated and secured within a recess (unnumbered) of a conventional drain housing 41 of the roof R.

Figure 2:
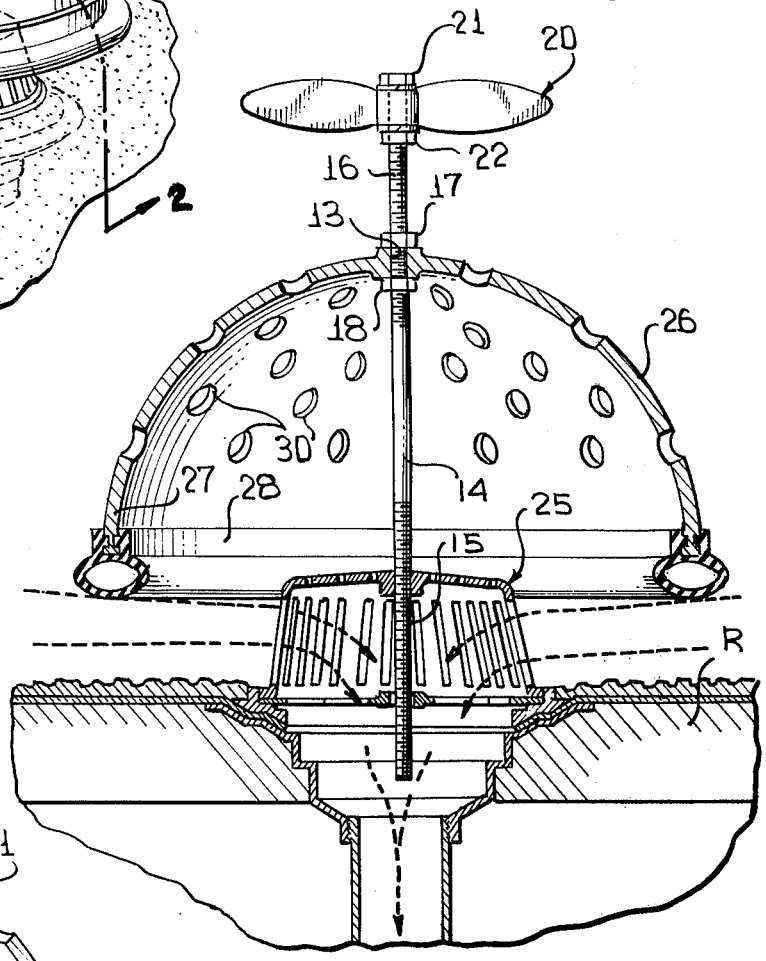
FIG. 2 is a fragmentary enlarged sectional view taken generally along line 2—2 of FIG. 1, and illustrates details of the closure device of FIG. 1, including the apertures of the cap, a peripheral seal carried by an edge of the cap, and the manner in which a threaded stem is united to a conventional apertured drain closure.

Under normal conditions it can be assumed that the cap 11 is in the raised position thereof, shown in FIGS. 1 and 2. In this case, water will normally drain through the conventional drain closure 25 in the manner illustrated in FIG. 2. Should, however, a fire develop in the building, water can be directed against the wing nut 20 in the manner indicated by the force lines F in FIG. 1 to rotate the rod 14 and the cap 11 therewith to achieve the sealed condition shown in FIG. 3. Alternately, the cap 11 can be manually rotated by rotating the wing nut 20, and in either event water will be held captive upon the roof R due to the seal created between the latter and the peripheral seal 28. Obviously, an excessive amount of water is undesirable and thus a predetermined water level will be maintained as dictated by the lowermost ones of the apertures 30, in the manner indicated in FIG. 3. Thus, irrespective of the condition (open or closed) of the cap 11 water will be maintained at a predetermined level upon the roof R (FIG. 3), water will drain thereoff (FIG. 2), or in the latter condition (FIG. 2) the cap 11 can be closed in the manner heretofore described by the application of any force to the rod 14 through the wing nut 20. In this manner it is assured that a predetermined water level can be maintained under normal conditions or under adverse conditions should a fire develop.

While preferred forms and arrangement of parts have been shown in illustrating the invention, it is to be clearly understood that various changes in details and arrangement of parts may be made without departing from the scope and spirit of this disclosure.

I claim:

1. The combination of a roof, roof drain and closure device, said roof drain being defined by an opening in said roof for draining water therefrom, a closure device including an inverted generally cup-shaped cap, said cap having an apex portion and a peripheral skirt, said peripheral skirt having a lowermost peripheral edge portion terminating in a peripheral terminal edge, peripheral sealing means carried by said peripheral terminal edge for sealingly engaging a peripheral area of said roof outboard of said roof drain in closed position of said closure device, said peripheral skirt being devoid of aperture means from said peripheral terminal edge to a predetermined height thereabove, aperture means above said peripheral edge portion beginning at said predetermined height whereby in said closed position water will accumulate upon said roof to a height generally equal to said predetermined height, rod means connected to said apex portion, and means for connecting said rod means to said roof drain whereby upon axial motion of said rod means said peripheral sealing means will be brought into and out of contact with said perhperal area to respectively form and break a seal between the latter and said peripheral sealing means.

2. The combination as defined in claim 1 wherein said rod means is a threaded member, and said peripheral edge portion is devoid of aperture means between said peripheral terminal edge and said predetermined height.

3. The combination as defined in claim 1 wherein said rod means is a threaded member, said peripheral edge portion is devoid of aperture means between said peripheral terminal edge and said predetermined height, means for fixedly securing said cap to said rod means whereby upon rotation of saod rod means said cap rotates therewith, and said rod means to said roof drain connecting means is a rotatable connection.

* * * * *